US008585151B2

(12) United States Patent
Goldman et al.

(10) Patent No.: US 8,585,151 B2
(45) Date of Patent: Nov. 19, 2013

(54) BEAN BAG CHAIR WITH STORAGE COMPARTMENT

(76) Inventors: Amber I. Goldman, Alhambra, CA (US); Andrea Soto-Camacho, Los Angeles, CA (US); Karen G. Stash, Los Angeles, CA (US)

( * ) Notice: Subject to any disclaimer, the term of this patent is extended or adjusted under 35 U.S.C. 154(b) by 94 days.

(21) Appl. No.: 13/136,155

(22) Filed: Jul. 25, 2011

(65) Prior Publication Data

US 2013/0026801 A1 Jan. 31, 2013

(51) Int. Cl.
*A47C 7/18* (2006.01)
*A47C 7/20* (2006.01)

(52) U.S. Cl.
USPC ..... 297/452.17; 297/188.08; 297/188.13

(58) Field of Classification Search
USPC ..... 297/452.17, 188.09, 188.12, 188.13
See application file for complete search history.

(56) References Cited

U.S. PATENT DOCUMENTS

| | | | | |
|---|---|---|---|---|
| 3,495,874 | A * | 2/1970 | Dean | 297/452.17 |
| 3,899,210 | A * | 8/1975 | Samhammer et al. | 297/448.2 |
| 4,011,611 | A * | 3/1977 | Lederman | 5/655.4 |
| 4,096,929 | A * | 6/1978 | Frey et al. | 383/4 |
| 4,914,765 | A * | 4/1990 | Smith | 5/639 |
| 5,240,330 | A * | 8/1993 | Thompson | 383/4 |
| D355,306 | S * | 2/1995 | Moses | D6/333 |
| 6,209,962 | B1 * | 4/2001 | Sobel et al. | 297/452.17 |
| 6,371,641 | B1 * | 4/2002 | Wilson, Jr. | 383/4 |
| 6,406,098 | B1 * | 6/2002 | Linder | 297/452.41 |
| D504,269 | S * | 4/2005 | Faircloth | D6/601 |
| 6,899,387 | B2 * | 5/2005 | Ariizumi | 297/181 |
| 7,461,421 | B1 * | 12/2008 | Faircloth et al. | 5/639 |
| D651,841 | S * | 1/2012 | Nayman | D6/601 |
| 2003/0151295 | A1 * | 8/2003 | Nelson | 297/452.17 |
| 2010/0314916 | A1 * | 12/2010 | Walser | 297/188.09 |
| 2011/0181081 | A1 * | 7/2011 | Williams et al. | 297/188.09 |

FOREIGN PATENT DOCUMENTS

GB 2059758 A * 4/1981

* cited by examiner

*Primary Examiner* — David Dunn
*Assistant Examiner* — Richard Lowry
(74) *Attorney, Agent, or Firm* — James R. Brueggemann

(57) ABSTRACT

An improved bean bag chair is disclosed that not only provides conforming support for a person's body in a variety of positions, but also provides a closable storage compartment for storing a large number of miscellaneous articles of varying size, shape and hardness, all without compromising the chair's effectiveness in providing conforming support. The chair includes an upper flexible bag defining an upper compartment that carries an adaptable filler material, and it further includes a lower flexible bag defining a lower compartment for receiving and storing the miscellaneous articles. A closure, e.g., a zipper, secures the upper and lower flexible bags together.

15 Claims, 2 Drawing Sheets

BEAN BAG CHAIR WITH STORAGE COMPARTMENT

BACKGROUND OF THE INVENTION

This invention relates generally to chairs and, more particularly, to bean bag chairs that include an adaptable filler material carried within a flexible bag to support a person's body in a variety of positions.

Bean bag chairs have enjoyed widespread use and have been popular for many decades. Such chairs typically include a flexible bag formed of a suitable fabric, leather, or imitation leather, forming a closed, generally spherical compartment. An adaptable filler material is disposed within the closed compartment. Suitable filler material includes polystyrene beads, expanded polystyrene beads, polyvinyl chloride pellets, shredded polyurethane foam, shredded latex foam, dried beans, recycled plastic bottle pellets, and mixtures of those materials. In use, a person can sit on the bean bag chair and nestle down into a comfortable position, with the filler material adapting to the shape of the person's body and conformably supporting the body.

In the past, bean bag chairs have functioned only as simple chairs, although sometimes they have been configured to provide an additional, adjunct function of storing an article that might be used by a person sitting on the chair, e.g., a magazine or a remote control for a television. These limited functions all are satisfactory, but they fail to provide other valuable functions as well.

It should be appreciated that there is a need for an improved bean bag chair that is configured to provide an additional function of storing numerous articles of varying size, shape, and hardness, without compromising the chair's ability to provide its normal function of conformably supporting a person's body. The present invention fulfills this need and provides further related advantages.

SUMMARY OF THE INVENTION

The present invention is embodied in a bean bag chair that includes an upper compartment carrying an adaptable filler material for conformably supporting a person's body in a variety of positions, and that further includes a lower compartment sized and configured to receive and store numerous articles of varying size, shape, and hardness. The chair includes an upper flexible bag forming the upper compartment, and it further includes a container secured to the upper flexible bag and forming the lower compartment. The upper compartment extends over substantially all of the lower compartment. In addition, the lower container defines a closable opening for allowing the plurality of articles to be inserted into, and removed from, the lower compartment.

In more detailed features of the invention, the lower container includes a lower flexible bag, and both flexible bags are formed of a material selected from the group consisting of fabric, leather and imitation leather. Preferably, the two bags are formed of the same material. In addition, the adaptable filler material preferably is selected from the group consisting of polystyrene beads, expanded polystyrene beads, polyvinyl chloride pellets, shredded polyurethane foam, shredded latex foam, dried beans, recycled plastic bottle pellets, and combinations of those materials. The upper flexible bag includes a closable opening sized to allow insertion of the filler material.

In other more detailed features of the invention, the lower flexible bag is sized and configured such that the lower compartment includes a generally cylindrical wall portion. In addition, the bean bag chair further can include a layer of foam material secured to this cylindrical wall portion. This helps to ensure that the cylindrical wall portion remains upright when the closure is opened and articles are being inserted into or removed from the lower compartment.

In another more detailed feature of the invention, the bean bag chair further includes a closure for selectively closing the closable opening defined by the lower flexible bag. This closure preferably is selected from the group consisting of a zipper, a hook-and-loop fastener, one or more snaps, one or more buttons, and combinations thereof. Further, the closure can be carried by abutting portions of the upper and lower flexible bags, for further use in securing the bags to each other.

The upper and lower flexible bags preferably are secured to each other by the closure in combination with a length of stitching, such that the closure and the stitching form a loop that closes off the lower compartment. Alternatively, the closure can extend entirely around the lower compartment. The upper and lower compartments preferably are sized substantially comparable to each other.

Other features and advantages of the invention should become apparent from the following description of the preferred embodiments, taken in conjunction with the accompanying drawings, which illustrate, by way of example, the principles of the invention.

BRIEF DESCRIPTION OF THE DRAWINGS

FIG. 4 also depicts a strip of foam material secured in the generally cylindrical side wall portion of the lower flexible bag.

DESCRIPTION OF THE PREFERRED EMBODIMENTS

Figure 1:
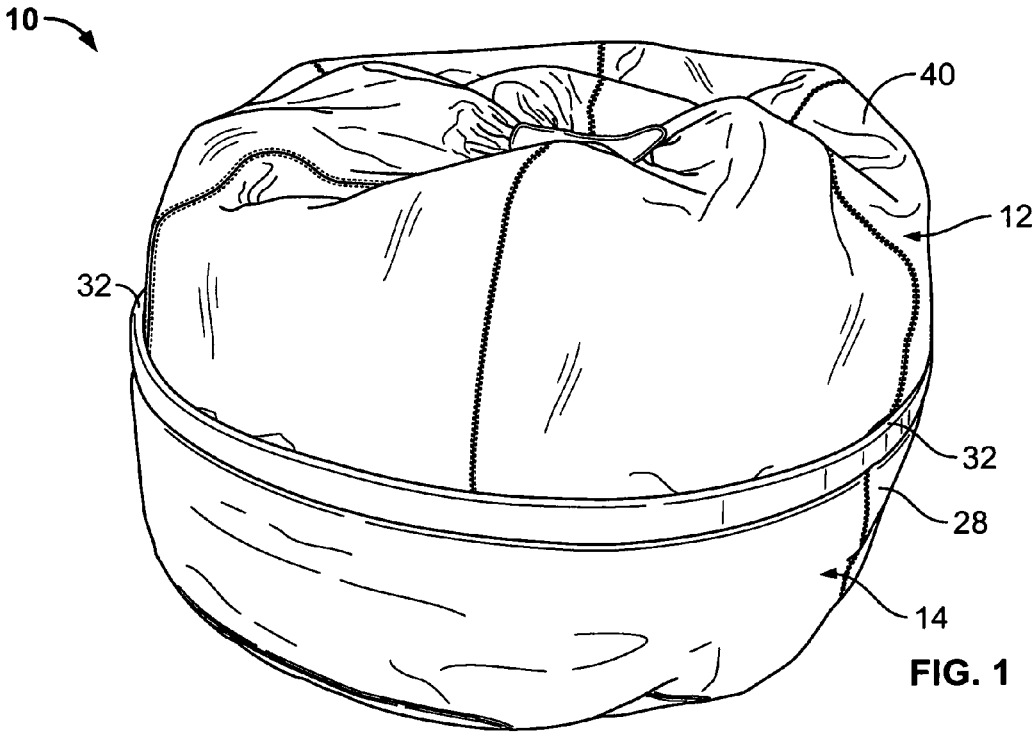
FIG. 1 is an upper front oblique view of a preferred embodiment of a bean bag chair in accordance with the invention, the chair including an upper flexible bag that defines an upper compartment carrying an adaptable filler material and a lower flexible bag defining a lower compartment that can be used to receive and store numerous small articles of varying size, shape, and hardness.
Figure 2:
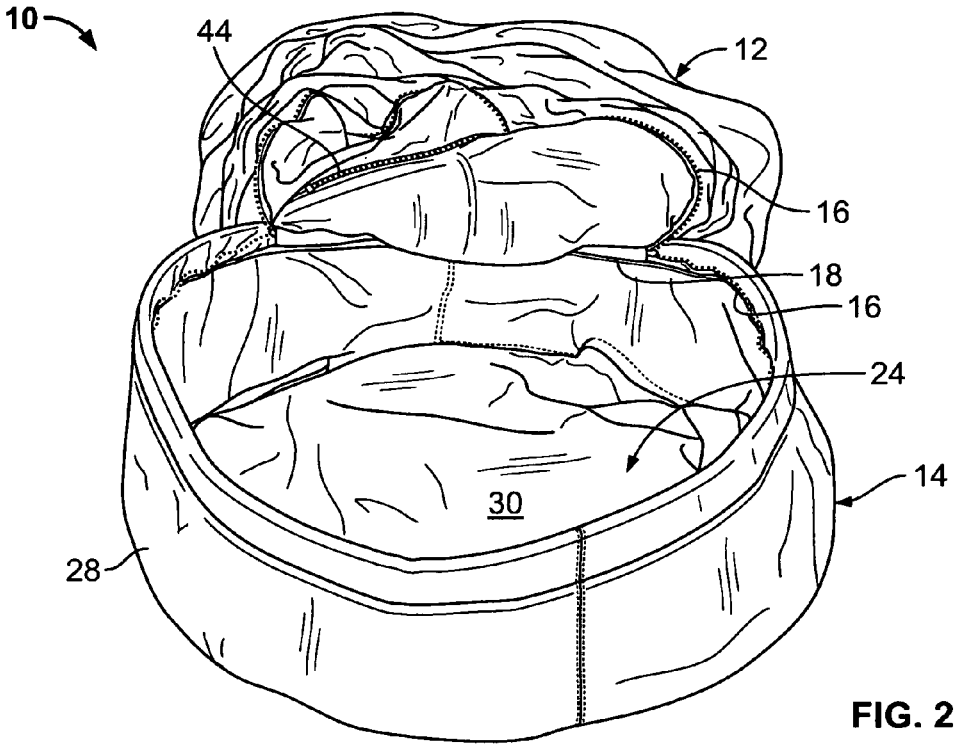
FIG. 2 is an upper front oblique view of the bean bag chair of FIG. 1, with a zipper that secures the upper and lower flexible bags together being fully opened and the upper bag moved aside to expose the open lower compartment, depicted as being empty of any small articles.
Figure 3:
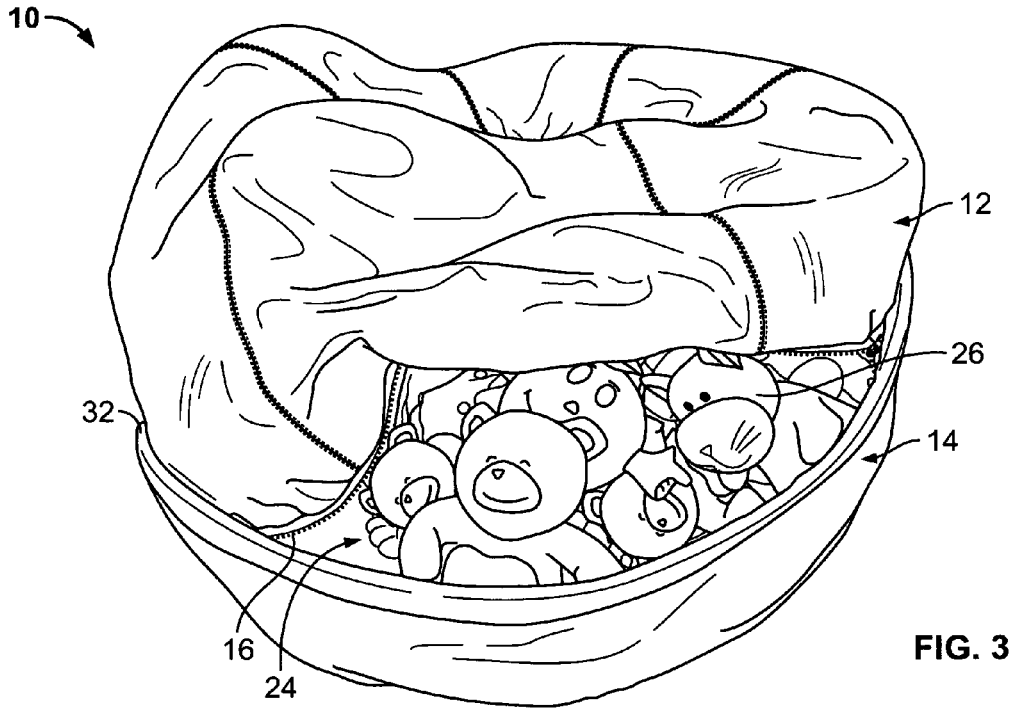
FIG. 3 is an upper front oblique view of the bean bag chair of FIG. 1, with the lower compartment filled with numerous small articles in the form of plush toys and with the zipper partially closed.
Figure 4:
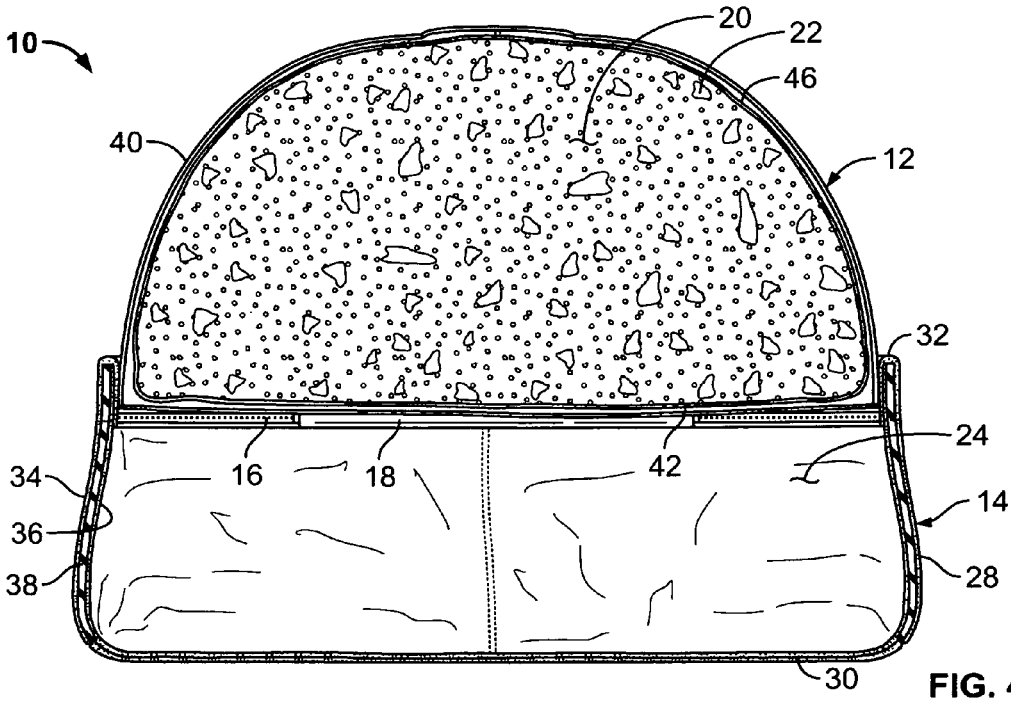
FIG. 4 is a side sectional view of the bean bag chair of FIG. 1, depicting the adaptable filler material carried within a separate envelope in the upper compartment, but for simplicity not depicting any small articles stored in the lower compartment.

With reference now to FIGS. 1-4 of the illustrative drawings, there is shown a bean bag chair 10 in accordance with a preferred embodiment of the invention. The chair includes an upper flexible bag 12 and a lower flexible bag 14, which are secured to each other by a zipper 16 and by a section of stitching 18 (FIGS. 2 and 4). The upper flexible bag defines a closed upper compartment 20 (FIG. 4) that carries a suitable bean-like filler material 22. The lower flexible bag defines a lower compartment 24 (FIGS. 2-4) sized and configured to receive and store a large number of miscellaneous small articles 26 (FIG. 3) of varying size, shape, and hardness, e.g., non-breakable toys, blankets, and clothing.

In use, the zipper 16 can be manually opened to expose the lower compartment 24 and allow the miscellaneous articles 26 to be placed within it for storage. Thereafter, the zipper can be closed, whereupon the chair 10 takes on the appearance of a conventional bean bag chair, functioning to support a person's body in a variety of positions.

More particularly, and with reference to FIG. 2, the lower flexible bag 14 is shown with the zipper 16 in its open position and the upper flexible bag 12 moved aside to expose the lower compartment 24. The lower bag includes a side wall 28 and a generally disc-shaped bottom wall 30. This provides the lower compartment with a generally cylindrical shape, with an open top surrounded by a circular upper edge 32 of the side wall.

Preferably, the walls of the lower bag include an outer ply 34 and an inner ply 36. The outer ply preferably is formed of an attractive, but durable material such as leather, imitation leather, cotton or polyester fabric. The preferred material is a polyester microfiber. The inner ply preferably is formed of a durable material such as cotton/polyester muslin. A layer 38 of foam material preferably is interposed between the outer and inner plies of the lower bag's side wall 28, to provide the wall with sufficient rigidity to remain generally upright even when the zipper 16 is opened and the upper flexible bag 12 is moved aside and the lower compartment 24 is empty. Suitable materials for this foam layer 38 include polyurethane foam, natural foam rubber latex, a recycled polyfiber, or any other suitable quilting or iron-on interfacing, in a preferred thickness of about ¼ inch.

With continued reference to FIGS. 2 and 4, the upper flexible bag 12 includes a dome-shaped top wall 40 and a generally disc-shaped bottom wall 42. These walls define the closed upper compartment 20 for carrying the bean-like adaptable filler material 22.

The dome-shaped top wall 40 of the upper flexible bag 12 preferably includes just a single ply of a material that is the same as is used for the outer ply 34 of the lower flexible bag 14. This top wall preferably is formed by six identically sized panels sewn together to form a half-sphere having a preferred diameter in the range of 20 to 80 inches. Of course, fewer or more panels alternatively could be used. These panels are ruched or pleated at the top of the half-sphere and sewn into a seven-inch circle, creating an appearance similar to that of a beach ball.

The generally disc-shaped bottom wall 42 of the upper flexible bag 12 preferably is formed by a single ply of a suitable muslin material. This wall carries a closable zippered opening 44 (FIG. 2), which can be manually opened to allow insertion of the adaptable filler material 22. Preferably, the adaptable filler material is carried within its own envelope 46 (FIG. 4), formed of a material such as polyester. Suitable materials that can be used as the bean-like filler material 22 include polystyrene beads, expanded polystyrene beads, polyvinyl chloride pellets, shredded polyurethane foam, shredded latex foam, dried beans, recycled plastic bottle pellets, and combinations of those materials. The envelope and filler material can be readily replaced, as necessary. In addition, the envelope and filler material can be removed from the upper compartment 24 when it is necessary for the upper and lower flexible bags 12, 14, respectively, to be cleaned.

The zipper 16 preferably includes a double head, so that it can be opened from either or both of its ends. When the zipper is fully opened, the stitching 18 acts as a hinge to keep the upper flexible bag 12 attached to the lower flexible bag 14. The lower half of the zipper is attached to the inside portion of the side wall 28 of the lower flexible bag 14 about two inches below the side wall's upper edge 32. This defines a fabric lip that covers the zipper when the zipper is closed.

In an alternative embodiment, not depicted in the drawings, a layer of foam material can be secured to the disc-shaped bottom wall 40 of the upper flexible bag 12. This foam layer can serve to cushion any irregularities in the collection of miscellaneous articles 26 being stored in the lower compartment 24, which is especially useful when the chair 10 is in use supporting a person's body.

In another alternative embodiment, not depicted in the drawings, the lower compartment is defined by a container other than a flexible bag. Suitable materials for this alternative lower container include plastic and wood.

It should be appreciated from the foregoing description that the present invention provides an improved bean bag chair that not only provides conforming support for a person's body in a variety of positions, but that also provides a closable storage compartment for storing a large number of articles of varying size, shape and hardness, all without compromising the chair's effectiveness in providing conforming support.

The invention has been described in detail with reference only to the presently preferred embodiments. Persons skilled in the art will appreciate that various modifications can be made without departing from the invention. Accordingly, the invention is defined only by the following claims.

We claim:

1. A bean bag chair comprising:

an upper flexible bag forming an upper compartment;

an adaptable filler material disposed within the upper compartment; and a lower flexible bag secured to the upper flexible bag and forming a lower compartment, the lower flexible bag including a generally cylindrical wall portion that comprises a layer of foam material;

wherein the upper and lower flexible bags both comprise a material selected from the group consisting of fabric, leather and imitation leather;

wherein the upper compartment extends over substantially all of the lower compartment;

wherein the lower compartment is sized and configured to receive and store a plurality of articles of varying size, shape, and hardness;

wherein the lower flexible bag defines a closable opening for allowing the plurality of articles to be inserted into, and removed from, the lower compartment;

and wherein the bean bag chair is configured to support a person's body in a variety of positions.

2. The bean bag chair as defined in claim 1, wherein the upper and lower flexible bags are formed of the same material.

3. The bean bag chair as defined in claim 1, wherein the adaptable filler material is selected from the group consisting of polystyrene beads, expanded polystyrene beads, polyvinyl chloride pellets, shredded polyurethane foam, shredded latex foam, dried beans, recycled plastic bottle pellets, and combinations thereof.

4. The bean bag chair as defined in claim 1, and further comprising a closure for selectively closing the closable opening defined by the lower container.

5. The bean bag chair as defined in claim 4, wherein the closure is selected from the group consisting of a zipper, a hook-and-loop fastener, one or more snaps, one or more buttons, and combinations thereof.

6. The bean bag chair as defined in claim 4, wherein the closure is carried by abutting portions of the upper bag and the lower container, for further use in securing the lower container to the upper flexible bag.

7. The bean bag chair as defined in claim 6, wherein:

the bean bag chair further comprises a length of stitching that cooperates with the closure to secure the lower container to the upper flexible bag; and the length of stitching and the closure form a loop that closes off the lower compartment formed by the lower container.

8. The bean bag chair as defined in claim 1, wherein the upper and lower compartments are sized substantially comparable to each other.

9. The bean bag chair as defined in claim 1, wherein the upper flexible bag defines a closable opening sized to allow insertion of the adaptable filler material.

10. A bean bag chair comprising:

an upper flexible bag forming an upper compartment;

an adaptable filler material disposed within the upper compartment;

a lower flexible bag defining a generally cylindrical lower compartment having an open top, with a generally cylindrical wall portion comprising a layer of foam material and having a substantially circular upper edge, wherein the lower compartment is sized and configured to receive and store a plurality of articles of varying size, shape, and hardness; and a manually operable closure extending along a substantial portion of the circular upper edge of the lower flexible envelop bag, for securing the lower flexible bag to the upper flexible bag;

wherein the upper compartment extends over substantially all of the lower compartment;

wherein manually opening the closure defines an opening into the lower compartment, allowing the plurality of articles to be selectively inserted into, and removed from, the lower compartment;

and wherein the bean bag chair is sized and configured to conformably support a person's seat and back in a variety of positions.

11. The bean bag chair as defined in claim 10, wherein the upper and lower flexible bags are formed of the same material selected from the group consisting of fabric, leather and imitation leather.

12. The bean bag chair as defined in claim 10, wherein:

the adaptable filler material is selected from the group consisting of polystyrene beads, expanded polystyrene beads, polyvinyl chloride pellets, shredded polyurethane foam, shredded latex foam, dried beans, recycled plastic bottle pellets, and combinations thereof; and the upper flexible bag further includes a closable opening sized to allow insertion of the adaptable filler material.

13. The bean bag chair as defined in claim 10, wherein the closure is selected from the group consisting of a zipper, a hook-and-loop fastener, one or more snaps, one or more buttons, and combinations thereof.

14. The bean bag chair as defined in claim 13, wherein:

the bean bag chair further comprises a length of stitching that cooperates with the closure to secure the lower flexible bag to the upper flexible bag; and the length of stitching and the closure form a loop that closes off the lower compartment formed by the lower flexible bag.

15. The bean bag chair as defined in claim 10, wherein the upper and lower compartments are sized substantially comparable to each other.

* * * * *